US007444254B2

(12) United States Patent
Tsukada et al.

(10) Patent No.: US 7,444,254 B2
(45) Date of Patent: Oct. 28, 2008

(54) VALVE TIMING CONTROL APPARATUS OF INTERNAL COMBUSTION ENGINE

(75) Inventors: Tomoya Tsukada, Kanagawa (JP); Seiji Suga, Kanagawa (JP); Hideaki Nakamura, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 44 days.

(21) Appl. No.: 11/590,880

(22) Filed: Nov. 1, 2006

(65) Prior Publication Data

US 2007/0101962 A1 May 10, 2007

(30) Foreign Application Priority Data

Nov. 4, 2005 (JP) ..... 2005-320247

(51) Int. Cl.
*G01L 25/00* (2006.01)
*F01L 1/34* (2006.01)

(52) U.S. Cl. ..... 702/114; 123/90.15; 123/90.17

(58) Field of Classification Search ..... 702/33, 702/41, 113, 114, 151, 158; 123/90.15, 90.17, 123/90.34, 90.16
See application file for complete search history.

(56) References Cited

U.S. PATENT DOCUMENTS 5,657,725 A 8/1997 Butterfield et al.
2002/0062803 A1 5/2002 Sato et al.
2005/0028773 A1* 2/2005 Komaki ..... 123/90.17
2005/0103297 A1 5/2005 Simpson

FOREIGN PATENT DOCUMENTS

EP 1 533 484 A2 5/2005
JP 2005-147153 6/2005

* cited by examiner

*Primary Examiner*—Bryan Bui
(74) *Attorney, Agent, or Firm*—Foley & Lardner LLP

(57) ABSTRACT

A valve timing control apparatus is adapted to an exhaust valve side of an internal combustion engine. A vane member is arranged to rotate with a camshaft relative to a timing sprocket member. The vane member is rotated at low speed engine operation dominantly by a camshaft-torque actuation mechanism and at high speed engine operation dominantly by a hydraulic actuation mechanism. The camshaft-torque actuation mechanism is actuated by an alternating torque of the camshaft, whereas the hydraulic actuation mechanism is actuated by a fluid pump. The vane member includes a first vane arranged to operate in the camshaft-torque actuation mechanism and a second vane arranged to operate in the hydraulic actuation mechanism. The first vane has a shorter radial length and a smaller pressure-receiving area than the second vane.

23 Claims, 7 Drawing Sheets

VALVE TIMING CONTROL APPARATUS OF INTERNAL COMBUSTION ENGINE

BACKGROUND OF THE INVENTION

The present invention relates generally to a valve timing control (VTC) apparatus for controlling a valve timing of an internal combustion engine such as opening and closing timings of engine valves such as intake and exhaust valves, and more particularly to a valve timing control apparatus which actuates a phase alteration mechanism with an alternating torque of a camshaft and a hydraulic pressure.

A Japanese Patent Application Publication No. 2005-147153 shows a camshaft phasing device or valve timing control apparatus of a vane type, which employs: a cam torque actuated (CTA) phaser or camshaft-torque actuation mechanism to rotate a vane member with fluctuations of an alternating torque of a camshaft as a driving source; and an oil pressure actuated (OPA) phaser or hydraulic actuation mechanism to rotate the vane member with a discharge pressure of an oil pump as a driving source.

Specifically, in the conventional valve timing control apparatus, a cylindrical housing is closed at its front open end by a front cover and is closed at its rear open end by a rear cover. A vane member including a plurality of CTA vanes and a plurality of OPA vanes is rotatably disposed within the housing. The CTA vanes are driven in one rotational direction by fluctuations of the alternating torque of a camshaft, whereas the OPA vanes are driven in the opposite rotational direction by the discharge pressure of the oil pump. The vane member is coupled at its central portion to an end of a camshaft, such as an exhaust camshaft.

The housing is formed with a plurality of shoes in the inside peripheral surface. Each of the vanes of the vane member and the shoes of the housing define an advance fluid pressure chamber and a retard fluid pressure chamber. A spool valve is disposed slidably within the vane member to supply and drain an oil pressurized by the oil pump to and from the fluid pressure chambers.

The CTA vanes are rotated in one rotational direction by the camshaft-torque actuation mechanism including the spool valve when the discharge pressure of the oil pump is low, for example, at the time of engine start or at the time of low speed engine operation, whereas the OPA vanes are rotated in the opposite rotational direction by the hydraulic actuation mechanism when the discharge pressure of the oil pump is high, for example, at the time of high speed engine operation. The radial length of each CTA vane is substantially the same as that of each OPA vane.

The vane member is rotated in normal and reverse directions by the alternating torque and the hydraulic pressure, resulting in an alteration in the relative rotational phase of the camshaft with respect to a timing pulley. Thus, the opening and closing timings of each exhaust valve is controlled in accordance with the engine operating conditions.

SUMMARY OF THE INVENTION

In the above-mentioned camshaft-torque actuation mechanism, as the volumetric capacity of the fluid pressure chambers defined by the CPA vane decreases, and as the pressure-receiving area thereof decreases, the dynamic responsiveness of the vane member is improved. On the other hand, as the volumetric capacity of the fluid pressure chambers defined by the OPA vane increases, and as the pressure-receiving area thereof increases, the dynamic responsiveness of the vane member is improved.

If the radial length of each vane is set in consideration of one of the above two mutually contradictory demands on the dynamic responsiveness of the vane member, the dynamic responsiveness of the vane member based on the other demand is adversely affected.

Specifically, when the radial length of each vane is set relatively long in order to ensure a suitable dynamic responsiveness at the time of high fluid pressure or at the time of high speed engine operation, the dynamic responsiveness of the camshaft-torque actuation mechanism is adversely affected. On the other hand, when the radial length of each vane is set relatively short in order to ensure a suitable dynamic responsiveness at the time of low fluid pressure or at the time of low speed engine operation, the dynamic responsiveness of the hydraulic actuation mechanism is adversely affected.

Accordingly, it is an object of the present invention to provide a valve timing control apparatus of an internal combustion engine which alters with a desired responsiveness a relative rotational phase of a driven rotator with respect to a driving rotator.

According to one aspect of the present invention, a valve timing control apparatus for an internal combustion engine, comprises: a driving rotator adapted to be rotated by a torque outputted from the internal combustion engine; a driven rotator arranged to rotate with a relative rotational phase with respect to the driving rotator and adapted to transmit the torque from the driving rotator to a camshaft of the internal combustion engine via a torque transmission path; a camshaft-torque actuation mechanism including at least a pair of camshaft-torque actuation chambers arranged in the torque transmission path, the camshaft-torque actuation mechanism being configured to alter the relative rotational phase by providing at least a state allowing a unidirectional flow of working fluid from one of the camshaft-torque actuation chambers to another of the camshaft-torque actuation chambers; and a hydraulic actuation mechanism including at least a pair of hydraulic actuation chambers arranged in the torque transmission path, the hydraulic actuation mechanism being configured to alter the relative rotational phase at least by supplying and draining working fluid to and from one of the hydraulic actuation chambers, a first rate of alteration with respect to alteration in the relative rotational phase, at which the hydraulic actuation chambers alter in volumetric capacity in accordance with an alteration in the relative rotational phase, being higher than a second rate of alteration with respect to alteration in the relative rotational phase, at which the camshaft-torque actuation chambers alter in volumetric capacity in accordance with the alteration in the relative rotational phase. The driving rotator may be adapted to be driven by a crankshaft of the internal combustion engine. The at least a pair of hydraulic actuation chambers may be greater in number than the at least a pair of camshaft-torque actuation chambers. The camshaft-torque actuation mechanism may be configured to alter the relative rotational phase by providing selectively at least a state allowing a unidirectional flow of working fluid from one of the camshaft-torque actuation chambers to another of the camshaft-torque actuation chambers and a state allowing a unidirectional flow of working fluid from the another of the camshaft-torque actuation chambers to the one of the camshaft-torque actuation chambers. The camshaft-torque actuation mechanism may be configured to alter the relative rotational phase by providing selectively at least a state allowing a unidirectional flow of working fluid from one of the camshaft-torque actuation chambers to another of the camshaft-torque actuation chambers and a state allowing bidirectional flow of working fluid between the camshaft-torque actuation chambers. The hydraulic actuation mechanism may be configured to alter the relative rotational phase by providing selectively at least a state in which working fluid is supplied to one of the hydraulic actuation chambers from outside and working fluid is drained from another of the hydraulic actuation chambers to outside and a state in which working fluid is supplied to the another of the hydraulic actuation chambers from outside and working fluid is drained from the one of the hydraulic actuation chambers to outside. The hydraulic actuation mechanism may be configured to alter the relative rotational phase by providing selectively at least a state in which working fluid is supplied to one of the hydraulic actuation chambers from outside and working fluid is drained from another of the hydraulic actuation chambers to outside and a state in which both of the hydraulic actuation chambers are hydraulically connected to an outside low pressure section. The valve timing control apparatus may further comprise a fluid pump adapted to be driven by the internal combustion engine and arranged to supply working fluid to the hydraulic actuation mechanism. The camshaft-torque actuation mechanism and the hydraulic actuation mechanism may be configured to operate in parallel with each other. The valve timing control apparatus may further comprise a solenoid-operated control valve arranged to control both of the camshaft-torque actuation mechanism and the hydraulic actuation mechanism. The valve timing control apparatus may further comprise a first solenoid-operated control valve arranged to control the camshaft-torque actuation mechanism and a second solenoid-operated control valve arranged to control the hydraulic actuation mechanism. The camshaft-torque actuation mechanism may include a check valve arranged to allow the unidirectional flow of working fluid. The camshaft-torque actuation chambers may have a lower level of leak to outside than the hydraulic actuation chambers. The camshaft-torque actuation mechanism may include a replenishing hydraulic circuit arranged to replenish the cam-torque actuation chambers with an amount of working fluid leaking from the cam-torque actuation chambers. The camshaft-torque actuation mechanism may include a check valve arranged in the replenishing hydraulic circuit to allow a unidirectional flow of working fluid to the cam-torque actuation chambers. The camshaft-torque actuation mechanism and the hydraulic actuation mechanism may be arranged to use, as a working fluid, a lubricating oil used to lubricate the internal combustion engine. The valve timing control apparatus may further comprise a lock mechanism arranged to lock, at start of the internal combustion engine, the relative rotational phase at a phase value allowing starting the internal combustion engine.

According to another aspect of the invention, a valve timing control apparatus for an internal combustion engine, comprises: a driving rotator adapted to be rotated by a torque outputted from the internal combustion engine; a driven rotator arranged to rotate with a relative rotational phase with respect to the driving rotator and adapted to transmit the torque from the driving rotator to a camshaft of the internal combustion engine via a torque transmission path; a camshaft-torque actuation mechanism including at least a pair of camshaft-torque actuation chambers arranged in the torque transmission path, the camshaft-torque actuation mechanism being configured to alter the relative rotational phase by providing at least a state allowing a unidirectional flow of working fluid from one of the camshaft-torque actuation chambers to another of the camshaft-torque actuation chambers; and a hydraulic actuation mechanism including at least a pair of hydraulic actuation chambers arranged in the torque transmission path, the hydraulic actuation mechanism being configured to alter the relative rotational phase at least by supplying and draining working fluid to and from one of the hydraulic actuation chambers, a first rate of flow with respect to alteration in the relative rotational phase, at which working fluid flows from the one of the camshaft-torque actuation chambers to the another of the camshaft-torque actuation chambers in accordance with an alteration in the relative rotational phase, being higher than a second rate of flow with respect to alteration in the relative rotational phase, at which working fluid flows from and to the one of the hydraulic actuation chambers in accordance with the alteration in the relative rotational phase.

According to a further aspect of the invention, a valve timing control apparatus for an internal combustion engine, comprises: a driving rotator adapted to be rotated by a torque outputted from the internal combustion engine; a driven rotator arranged to rotate with a relative rotational phase with respect to the driving rotator and adapted to transmit the torque from the driving rotator to a camshaft of the internal combustion engine; a vane member formed in one of the driving rotator and the driven rotator, the vane member including a first vane set and a second vane set; a plurality of shoes formed in another of the driving rotator and the driven rotator; a camshaft-torque actuation mechanism including at least a pair of camshaft-torque actuation chambers defined by the first vane set and the shoes, the camshaft-torque actuation mechanism being configured to alter the relative rotational phase by providing at least a state allowing a unidirectional flow of working fluid from one of the camshaft-torque actuation chambers to another of the camshaft-torque actuation chambers; and a hydraulic actuation mechanism including at least a pair of hydraulic actuation chambers defined by the second vane set and the shoes, the hydraulic actuation mechanism being configured to alter the relative rotational phase at least by supplying and draining working fluid to and from one of the hydraulic actuation chambers, the second vane set having a larger total pressure-receiving area than the first vane set. The first vane set may include at least a first vane extending radially and outwardly from a base section of the one of the driving rotator and the driven rotator, the second vane set may include at least a second vane extending radially and outwardly from a base section of the one of the driving rotator and the driven rotator, and each of the shoes may extend radially and inwardly from an inner circumferential surface of the another of the driving rotator and the driven rotator. The second vane may have substantially the same circumferential length as the first vane and may have a longer radial length than the first vane. The at least a second vane may be greater in number than the at least a first vane. A first clearance between the first vane and a sliding surface of the another of the driving rotator and the driven rotator on which the first vane is arranged to slide may be smaller than a second clearance between the second vane and a sliding surface of the another of the driving rotator and the driven rotator on which the second vane is arranged to slide.

DETAILED DESCRIPTION OF THE INVENTION

Figure 1:
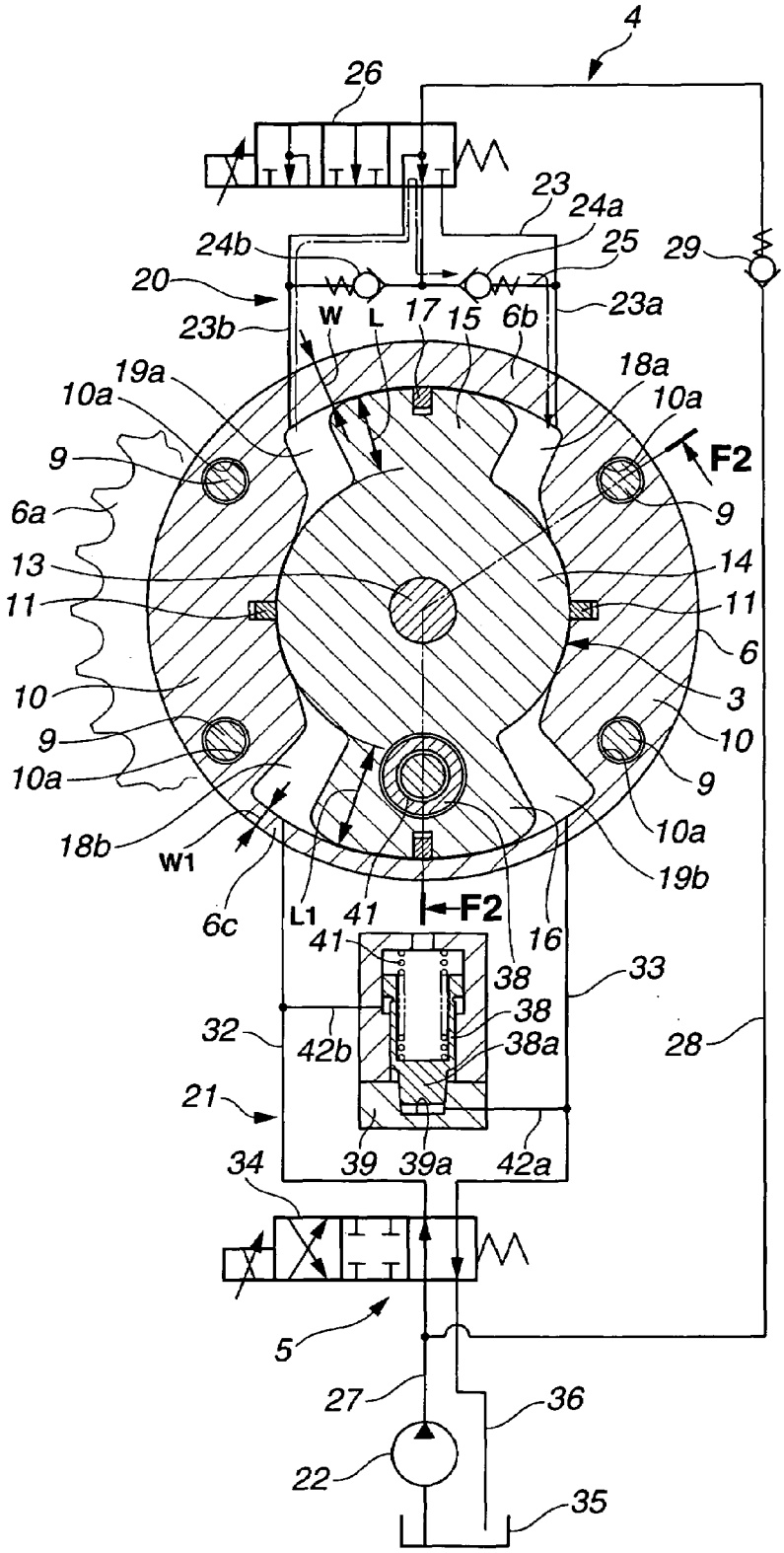
FIG. 1 is a sectional view taken along a line F1-F1 in FIG. 2, showing a valve timing control apparatus of an internal combustion engine in accordance with a first embodiment of the present invention.
Figure 2:
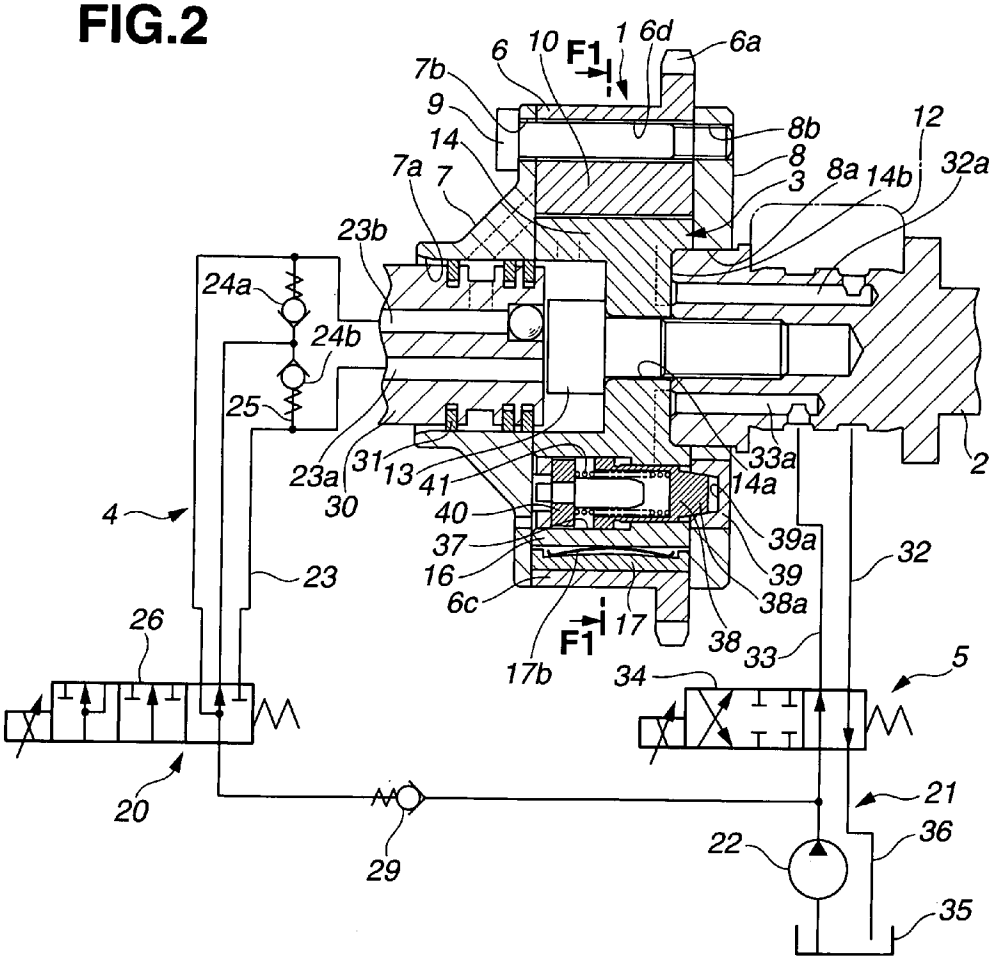
FIG. 2 is a sectional view taken along a line F2-F2 in FIG. 1, showing the valve timing control apparatus of FIG. 1.
Figure 3:
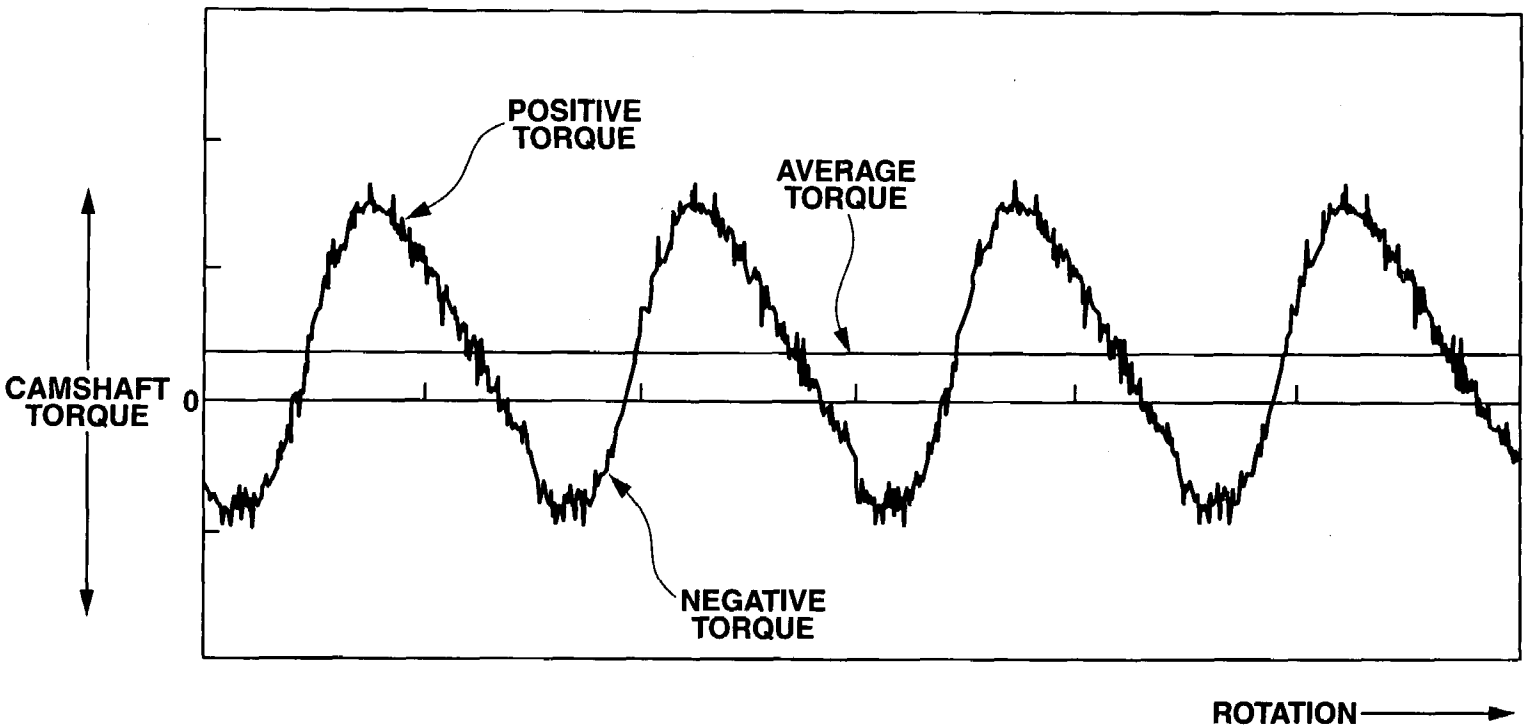
FIG. 3 is a graph showing waveform characteristics of an alternating torque transmitted from a camshaft of the engine.

FIG. 1 shows a valve timing control apparatus or system of an internal combustion engine in accordance with a first embodiment of the present invention. FIG. 2 shows the valve timing control apparatus in section taken along a line F2-F2 in FIG. 1 whereas FIG. 1 is a sectional view taken along a line F1-F1 shown in FIG. 2. The valve timing control apparatus of this embodiment is adapted to an exhaust valve side of the internal combustion engine.

A timing sprocket member 1 is a driving rotator driven through a timing chain by a crankshaft of the internal combustion engine. A camshaft 2 is rotatable relative to sprocket member 1. A vane member 3 is a driven rotator which is fixed at an end of camshaft 2 so that they rotate as a unit, and which is encased rotatably in sprocket member 1. A camshaft-torque actuation mechanism 4 is configured to allow the vane member 3 to rotate in one rotational direction in timing sprocket member 1 by means of an alternating torque transmitted from camshaft 2. A hydraulic actuation mechanism 5 is configured to rotate the vane member 3 in the other rotational direction within timing sprocket member 1 by means of a hydraulic pressure.

Timing sprocket member 1 includes a sprocket housing 6, a front cover 7 and a rear cover 8 which are joined together by fastening devices which, in this example, are four small-diameter bolts 9. Housing 6 is a hollow cylindrical member extending axially from a front open end to a rear open end. Housing 6 includes a toothed portion 6*a* formed integrally on the periphery of housing 6, and arranged to engage in links of the timing chain. Vane member 3 is enclosed rotatably in housing 5. Front cover 7 is in the form of a circular disk, and arranged to close the front open end of housing 6. Rear cover 8 is in the form of an approximately circular disk and arranged to close the rear open end of housing 6. Front cover 7, housing 6 and rear cover 8 are joined together to form a housing encasing the vane member 3, by the above-mentioned bolts 9 extending in the axial direction of the camshaft.

Housing 6 is approximately in the form of a hollow cylinder open at both ends. Housing 6 includes a plurality of partitions 10 projecting radially inwards from an inside circumferential wall surface of cylindrical housing 6. Projecting partitions 10 serve as housing shoes. In this example, the number of shoes 10 is two, and these two shoes 10 are arranged at angular intervals of approximately 180°. Housing 6 includes arced portions 6*b* and 6*c* of the periphery of different thicknesses arranged between shoes 10 and 10. Arced portion 6*b* located at an upper position of housing 6 in FIG. 1 has a thickness W whereas arced portion 6*c* located at a lower position of housing 6 has a thickness W1 greater than thickness W.

Each shoe 10 extends axially from the front open end to the rear open end of housing 6, and has an approximately trapezoidal cross section as viewed in FIG. 1. In this example, housing 6 includes a front end surface which is substantially flat and which is joined with front cover 7, and a rear end surface which is substantially flat and which is joined with rear cover 8. Each shoe 10 of this example includes a front end surface which is flat, and flush and continuous with the flat front end surface of housing 6, and a rear end surface which is flat, and flush and continuous with the flat rear end surface of housing 6. Two bolt holes 10*a* are formed in each shoe 10. Each bolt hole 10*a* passes axially through one of shoes 10, and receives one of the axially extending bolts 9. Each shoe 10 includes an inner end surface which is sloping in conformity with the outer shape of a later-mentioned vane rotor (14) of vane member 3. A retaining groove extends axially in the form of cutout in the inner end surface of each shoe at a substantially middle position. A U-shaped seal member 11 is fit in each retaining groove, and urged radially inwards by a leaf spring (not shown) fit in the retaining groove.

Front cover 7 is in the form of a circular disk including a central portion extending axially outwards, including a center retainer hole 7*a* having a relatively large inside diameter, and four bolt holes 7*b* each located at a peripheral position corresponding to one of bolt holes 6*d* of housing 6 receiving one of the axially extending bolts 9.

Rear cover 8 is in the form of a circular plate, including a center bearing hole 8*a* having a relatively large inside diameter and passing axially through rear cover 8. Rear cover 8 includes four threaded holes 8*b* arranged in the periphery into which the four bolts 9 are screwed, respectively.

Camshaft 2 is rotatably supported through a cam bearing and bearing bracket 12 on an upper portion of a cylinder head of the engine. Camshaft 2 includes one or more cams formed integrally on the outer circumference of camshaft 2 at predetermined positions. Each cam is arranged to open an exhaust valve of the engine through a valve lifter.

Vane member 3 of this example is a jointless single member made of sintered alloy. Vane member 3 includes a central vane rotor 14 and a plurality of vanes projecting radially outwards. In this example, the number of vanes is two, and first and second vanes 15 and 16 are arranged at angular intervals of approximately 180° circumferentially around vane rotor 14 and each formed in a sectoral shape. Vane rotor 14 is annular and includes a center bolt hole 14*a* at the center. Vane member 3 is fixed to a front end of camshaft 2 by a cam bolt 13 extending axially through the center bolt hole 14*a*.

Vane rotor 14 has an axial length substantially identical to the inside axial length of housing 6 so that the front end surface and rear end surface of vane rotor 14 are supported in sliding contact on opposed inside surfaces of front cover 7 and rear cover 8, respectively. Vane rotor 14 includes an annular fit hole 14*b* at the center of the front end. A front end portion of camshaft 2 is fit in fit hole 14*b*.

First and second vanes 15 and 16 are unequal in a radial length measured in the radial direction toward a common center axis of a rotary mechanism composed of vane member 3 and timing sprocket 1. The radial length of each vane is defined in accordance with the thickness of the wall of housing 6. First vane 15 is a smaller vane having a smaller radial length L in accordance with the thickness of arced portion 6*b*, whereas second vane 16 is a larger vane having a larger radial length L1 greater than L in accordance with the thickness of arced portion 6*c*.

Second vane 16 has a circumferential width greater than first vane 15. A part of a below-described lock mechanism is provided arranged axially within second vane 16.

First and second vanes 15 and 16 and the two shoes 10 of timing sprocket member 1 are arranged alternately in the circumferential direction around the center axis, as shown in FIG. 1. Namely, each vane 15 or 16 is located circumferentially between adjacent two of the shoes 10. Each vane 15 or 16 includes a retaining groove receiving a U-shaped seal member 17 in sliding contact with the inside cylindrical surface of housing 6, and a leaf spring 17*a* for urging the seal member 17 radially outward and thereby pressing the seal member 17 to the inside cylindrical surface of housing 6. Each retaining groove is formed substantially at a middle of an outer end of the associated vane. A first advance fluid pressure chamber 18*a* and a first retard fluid pressure chamber 19*a* are formed on both sides of first vane 15. First advance fluid pressure chamber 18*a* is defined between one side surface of first vane 15 and the adjacent shoe 10 to which the one side surface faces. First retard fluid pressure chamber 19*a* is defined between the other side surface of first vane 15 and the adjacent shoe 10 to which the other side surface faces. A second advance fluid pressure chamber 18*b* and a second retard fluid pressure chamber 19*b* are formed on both sides of second vane 16. Second advance fluid pressure chamber 18*b* is defined between one side surface of second vane 16 and the adjacent shoe 10 to which the one side surface faces. Second retard fluid pressure chamber 19*b* is defined between the other side surface of second vane 16 and the adjacent shoe 10 to which the other side surface faces. First advance fluid pressure chamber 18*a* and first retard fluid pressure chamber 19*a* serve as camshaft-torque actuation chambers. Second advance fluid pressure chamber 18*b* and second retard fluid pressure chamber 19*b* serve as hydraulic actuation chambers.

Thus, the total volumetric capacity of first advance fluid pressure chamber 18*a* and first retard fluid pressure chamber 19*a* is smaller than that of second advance fluid pressure chamber 18*b* and second retard fluid pressure chamber 19*b*.

Camshaft-torque actuation mechanism 4 includes first vane 15, first advance fluid pressure chamber 18*a*, first retard fluid pressure chamber 19*a*, and a first hydraulic circuit 20 configured to control a flow of working fluid between first advance fluid pressure chamber 18*a* and first retard fluid pressure chamber 19*a*.

Hydraulic actuation mechanism 5 includes second vane 16, second advance fluid pressure chamber 18*b*, second retard fluid pressure chamber 19*b*, and a second hydraulic circuit 21 configured to supply and drain selectively a fluid pressure of working fluid to and from each of second advance fluid pressure chamber 18*b* and second retard fluid pressure chamber 19*b*.

First hydraulic circuit 20 includes a communication passage 23 connecting first advance fluid pressure chamber 18*a* and first retard fluid pressure chamber 19*a* to each other; a bypass passage 25 arranged in parallel with communication passage 23; and a first directional control valve 26 arranged to vary a state of communication in communication passage 23 among first advance fluid pressure chamber 18*a*, first retard fluid pressure chamber 19*a* and a below-described replenishing passage 28. A first check valve 24*a* and a second check valve 24*b* are provided in bypass passage 25 in order to restrict the flow of working fluid as opposed unidirectional flows. A point in bypass passage 25 between first check valve 24*a* and second check valve 24*b* is hydraulically connected to first directional control valve 26. The working fluid is supplied to bypass passage 25 via the point when first directional control valve 26 is so controlled. Communication passage 23 is connected via first directional control valve 26 to a replenishing passage 28 branched from a main gallery 27 connected to a fluid pump, such as an oil pump 22. A third check valve 29 is provided in replenishing passage 28 to provide a unidirectional flow of working fluid from main gallery 27 to communication passage 23. Replenishing passage 28, when the working fluid leaks from first advance fluid pressure chamber 18*a* and first retard fluid pressure chamber 19*a*, serves to supply working fluid to them from oil pump 22.

Communication passage 23 allows the working fluid to flow from first advance fluid pressure chamber 18*a* to first retard fluid pressure chamber 19*a*, or allows the working fluid to flow from first retard fluid pressure chamber 19*a* to first advance fluid pressure chamber 18*a*, selectively, in accordance with an operational state of first directional control valve 26. As shown in FIG. 2, communication passage 23 includes two passage sections 23*a* and 23*b* formed within a cylindrical fluid passage section 30. Fluid passage section 30 passes though the retainer hole 7*a* of front cover 7. Fluid passage section 30 is formed with oil holes and grooves inside of fluid passage section 30 and on outer peripheral surfaces of fluid passage section 30. Front cover 7 is formed with an inclined oil hole inside. Fluid passage section 30 and vane rotor 14 define a cylindrical fluid chamber therebetween. Vane rotor 14 is formed with a fluid hole inside. Passage sections 23*a* and 23*b* are connected to first advance fluid pressure chamber 18*a* and first retard fluid pressure chamber 19*a* via the above oil holes, grooves, and chamber. Fluid passage section 30 includes three circumferential grooves on its outer cylindrical surface in each of which a seal ring 31 is fit to seal a portion between retainer hole 7*a* and fluid passage section 30.

First directional control valve 26 of this example is a solenoid valve having three ports and two positions. A valve element inside the first directional control valve 26 is arranged to alter the connection between first advance fluid pressure chamber 18*a* and first retard fluid pressure chamber 19*a*, and to alter the connection between replenishing passage 28 and one of first advance fluid pressure chamber 18*a* and first retard fluid pressure chamber 19*a* to which the working fluid is supplied in order to compensate an amount of working fluid that leaks from first advance fluid pressure chamber 18*a* and first retard fluid pressure chamber 19*a*. The inside spool valve element of first directional control valve 26 is controlled in accordance with a control current outputted by a below-described controller (not shown) to alter an open/closed state of each port.

Second hydraulic circuit 21 includes an advance communication passage 32 leading to second advance fluid pressure chamber 18*b*; a retard communication passage 33 leading to second retard fluid pressure chamber 19*b*; and a drain passage 36 connected to oil pan 35. A second directional control valve 34 is arranged to connect main gallery 27 to advance communication passage 32 and to retard communication passage 33 selectively, and also arranged to connect oil pan 35 to advance communication passage 32 and to retard communication passage 33 to drain the working fluid from one of second advance fluid pressure chamber 18*b* and second retard fluid pressure chamber 19*b*.

Advance communication passage 32 and retard communication passage 33 are connected to second advance fluid pressure chamber 18*b* and second retard fluid pressure chamber 19*b* via an advance communication hole 32*a* and a retard communication hole 33*a*, respectively. Advance communication hole 32*a* and retard communication hole 33*a* axially extend inside camshaft 2.

Second directional control valve 34 of this example is a solenoid valve having four ports and three positions. A valve element inside the second directional control valve 34 is arranged to alter the state of connection among main gallery 27, advance communication passage 32, retard communication passage 33 and drain passage 36. The inside spool valve element of second directional control valve 34 is controlled in accordance with a control current outputted by the below-described controller to alter an open/closed state of each port.

The controller produces control signals, and controls first directional control valve 26 and second directional control valve 34 by sending the control signals to first directional control valve 26 and second directional control valve 34, respectively. A sensor section collects input information on operating conditions of the engine and a vehicle in which this timing control apparatus is installed. The input information is supplied to the controller. The sensor section of this example includes a crank angle sensor for sensing a speed of the engine, an air flow meter for sensing an intake air quantity of the engine, other sensors, such as a throttle valve switch and an engine coolant sensor, a crank angle sensor, a cam angle sensor and an input device, such as an ignition switch or a vehicle main switch, to sense a start of the engine. The controller determines a current operating state based on the signals from the sensors, and further determines a relative rotational position between sprocket member 1 and camshaft 2.

A lock mechanism is a mechanism to prevent and allow the relative rotation between the driving rotator that is sprocket member 1 in this example and the driven rotator that is vane member 3 in this example. The lock mechanism is provided between the sprocket member 1 and vane member 3. In this example, the lock mechanism is formed between housing 6 and vane member 3.

As shown in FIG. 2, the lock mechanism is provided between rear cover 8 and second vane 16 having the wider width. The lock mechanism includes a lock pin 38 which is slidably received in a slide hole 37 formed in vane member 3. In this example, slide hole 37 is formed extending along the axial direction of camshaft 2 inside the second vane 16. Lock pin 38 is a cup-shaped member in the form of a hollow cylinder having one end closed. A tapered forward end portion of lock pin 38 is housed in or released from a lock recess 39*a* formed in a lock recess section 39. Lock recess section 39 is fixed in a fixing hole formed in rear cover 8. Lock recess section 39 is a hollow cup-shaped member to form lock recess 39*a*. A spring retainer 40 is fixed on the bottom of slide hole 37. A spring member 41 is retained by spring retainer 40 to urge the lock pin 38 toward lock recess 39*a*.

In a state in which vane member 3 is at a most advanced position, forward end portion 38*a* of lock pin 38 is inserted into lock recess 39*a* to lock the relative rotation between timing sprocket member 1 and camshaft 2. Lock pin 38 includes an outer large-diameter section slidably received in the outer large-diameter portion of slide hole 37; an inner small-diameter section slidably received in the inner small-diameter section of slide hole 37; and an annular step shoulder surface formed between the large-diameter section and the small-diameter section of lock pin 38. The step shoulder surface of lock pin 38 and slide hole 37 define a chamber, to which the working fluid is supplied from second advance fluid pressure chamber 18*b* and second retard fluid pressure chamber 19*b* via a fluid hole 42*a* and a fluid hole 42*b*. The supplied fluid pressure presses the lock pin 38 back from lock recess 39*a* to release the lock state of the lock mechanism.

The above-constructed valve timing control apparatus is operated as follows. At the time of rest of the engine, the controller inhibits supplying the control current to first directional control valve 26 and second directional control valve 34, so that the spool valve element of first directional control valve 26 is displaced by the action of the spring to allow the working fluid to flow from first retard fluid pressure chamber 19*a* into first advance fluid pressure chamber 18*a* via communication passage 23. On the other hand, the spool valve element of second directional control valve 34 is urged in one direction by the action of the spring to connect the retard communication passage 33 to drain passage 36 and to shut off the advance communication passage 32. Accordingly, the working fluid is drained from second retard fluid pressure chamber 19*b* to decompress the second retard fluid pressure chamber 19*b*, whereas no working fluid is supplied to second advance fluid pressure chamber 18*b*.

As a result of the above, vane member 3 rotates counterclockwise in FIG. 1 by means of an alternating torque of camshaft 2 caused just before the engine is completely stopped, especially by means of the positive torque component of the alternating torque. The alternating torque is a form of a twisting energy caused from the reaction force acted on each valve spring. At this time, the working fluid flows from first retard fluid pressure chamber 19*a* into first advance fluid pressure chamber 18*a* via communication passage 23 as shown by a dotted line in FIG. 1. As a result, vane member 3 is brought into a state in which second vane 16 having the wider width is in contact with a surface of one of the shoes 10 facing the second retard fluid pressure chamber 19*b*; the relative rotational phase of camshaft 2 with respect to timing sprocket member 1 is advanced.

At the time of rest of the engine, forward end portion 38*a* of lock pin 38 is fit in lock recess 39*a*, preventing relative rotation between timing sprocket member 1 and camshaft 2.

When the engine is started and brought into low speed conditions such as idle conditions, the controller produces a control signal so that first directional control valve 26 operates to allow the working fluid to flow from first retard fluid pressure chamber 19*a* into first advance fluid pressure chamber 18*a* via communication passage 23 and first check valve 24*a*. At this time, vane member 3 is rotated counterclockwise in FIG. 1 and held there by means of the positive component of the alternating torque of camshaft 2.

At the same time, second directional control valve 34 is energized to connect the second retard fluid pressure chamber 19*b* to drain passage 36 and to connect the second advance fluid pressure chamber 18*b* to main gallery 27. Accordingly, the working fluid is drained from second retard fluid pressure chamber 19*b* to decompress the second retard fluid pressure chamber 19*b*, whereas the working fluid is supplied to second advance fluid pressure chamber 18*b* from oil pump 22. The discharge pressure of oil pump 22 is however not enough high at this time. As a result, vane member 3 is held at an advanced rotational position by means of the alternating torque of camshaft 2, namely by camshaft-torque actuation mechanism 4.

In the above state, the relative rotational angle of camshaft 2 relative to timing sprocket member 1 is held at the most advanced position. Thus, the opening and closing timings of the exhaust valve is advanced so that the valve overlap with the intake valve is relatively small, resulting in improving the combustion efficiency by utilizing inertial intake air, in improving the engine cranking performance, and in stabilizing the idling operation.

At the time of low speed operation of the engine, the discharge pressure of oil pump 22 is relatively small and thereby the fluid pressure supplied to lock recess 39*a* is relatively small. Accordingly, lock pin 38 is held in lock recess 39*a*.

The lock mechanism in the lock state can prevent vibrations or flapping of vane member 3 due to alternating torque of camshaft 2 between the positive and negative sides to prevent abnormal sounds in the engine starting operation.

When after the above the vehicle starts to run to enter a predetermined middle or high speed operation region, the controller produces a control signal so that first directional control valve 26 controls communication passage 23 to allow the working fluid to flow from first advance fluid pressure chamber 18*a* to first retard fluid pressure chamber 19*a*. At the same time, second directional control valve 34 connects the second advance fluid pressure chamber 18*b* to drain passage 36 via advance communication passage 32 and connects the second retard fluid pressure chamber 19*b* to main gallery 27 via retard communication passage 33.

As a result of the above, the internal pressure of second advance fluid pressure chamber 18*b* is reduced whereas the internal pressure of second retard fluid pressure chamber 19*b* is enhanced by supplying the highly pressurized discharge pressure from oil pump 22 to second retard fluid pressure chamber 19*b*.

As the fluid pressure of second retard fluid pressure chamber 19*b* increases rapidly, lock pin 38 is moved back from lock recess 39*a* against the force of the spring, resulting in ensuring free rotation of vane member 3.

When the internal pressure of second retard fluid pressure chamber 19*b* is high, vane member 3 rotates clockwise maximally in FIG. 1 so that the relative rotational phase of camshaft 2 with respect to timing sprocket member 1 is altered to the most retarded position. Since the alternating torque of camshaft 2 is relatively small at this time, vane member 3 is rotated maximally on the retard side by the high fluid pressure of oil pump 22.

In the above state, the relative rotational angle of camshaft 2 relative to timing sprocket member 1 is held at the most retarded position. Thus, the opening and closing timings of the exhaust valve is retarded so that the valve overlap with the intake valve is relatively large, resulting in improving the intake efficiency and in enhancing the output power of the engine.

When vane member 3 rotates clockwise in the above process, the working fluid flows from first advance fluid pressure chamber 18*a* into first retard fluid pressure chamber 19*a* via communication passage 23 and second check valve 24*b*. As a result, the rotation of vane member 3 is rapidly achieved without receiving a flow resistance.

The above-constructed valve timing control apparatus is effective for suitably varying the opening/closing timing of the exhaust valve in accordance with the engine operating conditions in order to exploit the full engine performance, and also for enhancing the response of the normal and reverse rotation of vane member 3 to the action of the working fluid at the time of low pressure operation of the pump such as at the time of start of the engine and at the time of low speed operation of the engine since the radial length of first vane 15 is shorter than that of second vane 16 so that the volumetric capacity of first advance fluid pressure chamber 18*a* and first retard fluid pressure chamber 19*a* is smaller than that of second advance fluid pressure chamber 18*b* and second retard fluid pressure chamber 19*b*.

The construction that the radial length of first vane 15 is relatively short, results in that the inertial mass of first vane 15 is relatively small and the volumetric capacity of first advance fluid pressure chamber 18*a* and first retard fluid pressure chamber 19*a* is relatively small, and thereby results in enhancing the mobility of the working fluid between first advance fluid pressure chamber 18*a* and first retard fluid pressure chamber 19*a*. Accordingly, at the time of idling operation or low speed operation of the engine, camshaft-torque actuation mechanism 4 rotates the vane member 3 to the advance side with improved dynamic responsiveness.

On the other hand, the construction that the radial length of second vane 16 is relatively long enough, results in that the second vane 16 has an enough area for receiving the pressure of the working fluid of second retard fluid pressure chamber 19*b*, and results in that in the middle and high speed region of the engine, second vane 16 can effectively receive the high discharge pressure of oil pump 22. Accordingly, hydraulic actuation mechanism 5 rotates the vane member 3 with improved dynamic responsiveness.

Therefore the valve timing control apparatus of this example can alter the relative rotational phase of camshaft 2 with respect to timing sprocket member 1 with improved dynamic responsiveness both at the time of high pressure operation of oil pump 22 and at the time of low pressure operation of oil pump 22.

The mechanical structure of the valve timing control apparatus of the present embodiment may be constructed based on a basic structure and generally by maintaining the outside diameter of housing 6, increasing the thickness of arced portion 6*b*, and reducing the radial length of first vane 15. Accordingly, in order to obtain the valve timing control apparatus of this embodiment, it is unnecessary to increase the whole size larger than the basic structure, and to change a major structure of the basic structure. This minimizes the manufacturing cost of the valve timing control apparatus.

When the working fluid flows between first advance fluid pressure chamber 18*a* and first retard fluid pressure chamber 19*a*, the working fluid is supplied from oil pump 22 via replenishing passage 28 and third check valve 29 to first advance fluid pressure chamber 18*a* and first retard fluid pressure chamber 19*a*. This is effective for preventing that air enters first advance fluid pressure chamber 18*a* and first retard fluid pressure chamber 19*a*. This is also effective for preventing the dynamic responsiveness of vane member 3 from decreasing.

The provision of third check valve 29 prevents the working fluid from flowing reversely in replenishing passage 28 under conditions, such as at the time of rest of the engine, and thereby prevents the dynamic responsiveness of camshaft-torque actuation mechanism 4 at the time of start of the engine from decreasing.

The construction that the clearance between the front and rear surfaces of vane rotor 14 and first vane 15 and the inside surface of front cover 7 and rear cover 8 is reduced as small as possible, is effective for preventing the working fluid from leaking from first advance fluid pressure chamber 18*a* and first retard fluid pressure chamber 19*a*. As a result, vane member 3 is rotated by camshaft-torque actuation mechanism 4 with improved dynamic responsiveness. A seal device may be provided between the front and rear surfaces of vane rotor 14 and first vane 15 and the inside surface of front cover 7 and rear cover 8 in order to enhance the sealing performance. The foregoing effect is relatively large for camshaft-torque actuation mechanism 4 since the volumetric capacity of the camshaft-torque actuation chambers is relatively small.

Further, the construction that the working fluid can directly flow between first advance fluid pressure chamber 18*a* and first retard fluid pressure chamber 19*a*, is effective for enhancing the response of normal and reverse rotation of vane member 3 to the alternating torque.

The construction that camshaft-torque actuation mechanism 4 and hydraulic actuation mechanism 5 are both operative at a time, the relative rotational phase of camshaft 2 with respect to timing sprocket member 1 is altered with improved dynamic responsiveness.

In this example, oil pump 22 is also arranged to supply a lubricating oil to lubricate the engine. Accordingly, it is unnecessary to provide a special fluid pump for the valve timing control apparatus. This minimizes increase in the manufacturing cost.

The construction that camshaft-torque actuation mechanism 4 and hydraulic actuation mechanism 5 are controlled independently by first directional control valve 26 and second directional control valve 34, respectively, is effective for controlling the relative rotational phase accurately. For example, it is possible to prevent the vane member 3 from being rapidly rotated by one of the actuation mechanisms.

Figure 4:
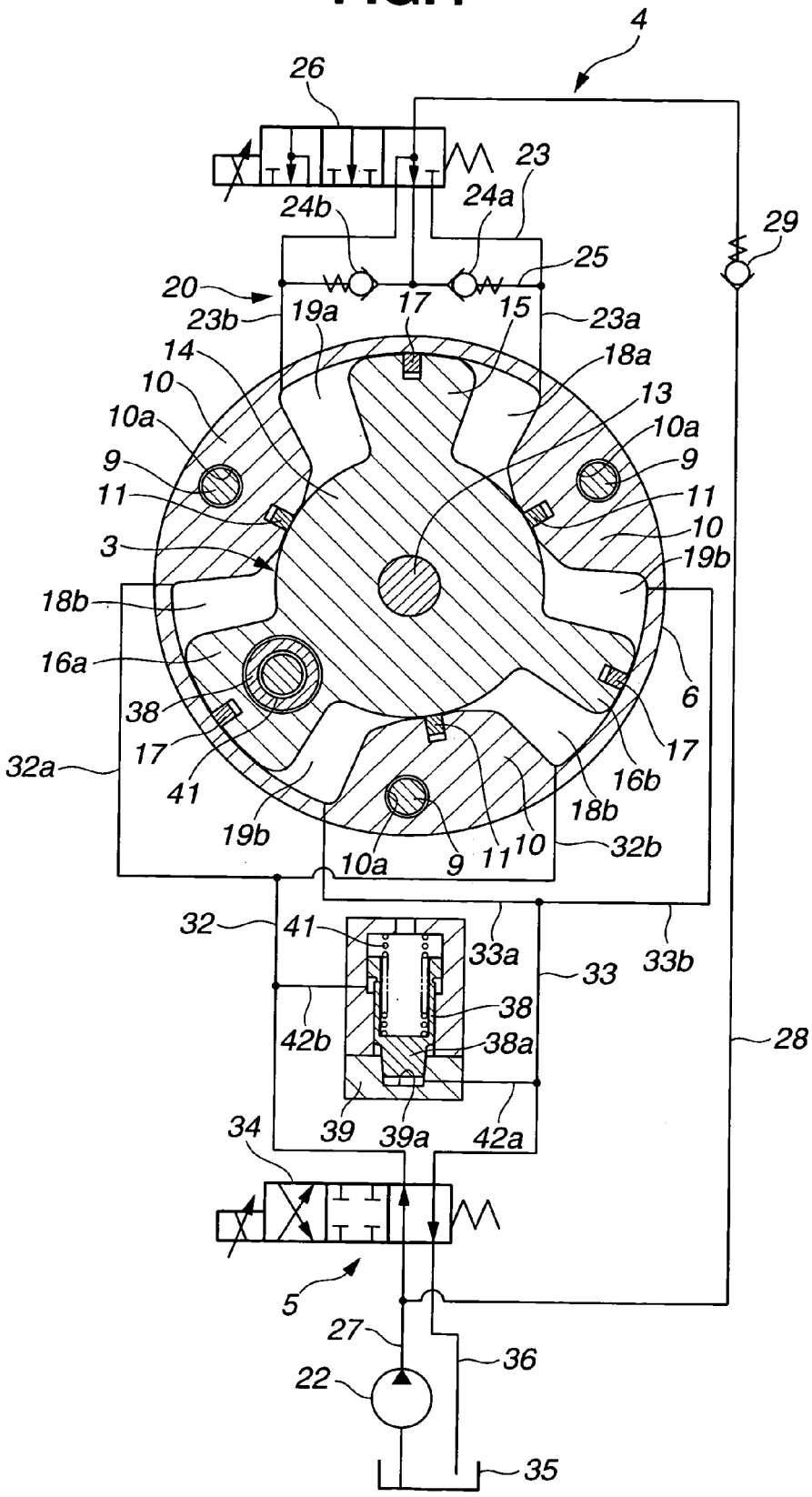
FIG. 4 is a sectional view showing a valve timing control apparatus of an internal combustion engine in accordance with a second embodiment of the present invention.

FIG. 4 shows a valve timing control apparatus of an internal combustion engine in accordance with a second embodiment of the present invention. In this example, camshaft-torque actuation mechanism 4 and hydraulic actuation mechanism 5 are constructed basically as in the first embodiment. The valve timing control apparatus of the second embodiment differs from that of the first embodiment in that: two second advance fluid pressure chambers 18*b* and 18*b* and two second retard fluid pressure chambers 19*b* and 19*b* are provided in hydraulic actuation mechanism 5; vane member 3 includes two second vanes 16*a* and 16*b* instead of second vane 16; the total volumetric capacity of two second advance fluid pressure chambers 18*b* and 18*b* and two second retard fluid pressure chambers 19*b* and 19*b* is greater than that of first advance fluid pressure chamber 18*a* and first retard fluid pressure chamber 19*a* of camshaft-torque actuation mechanism 4; and the total pressure-receiving area of two second vanes 16*a* and 16*b* is greater than that of first vane 15. In this embodiment, first vane 15, and second vanes 16*a* and 16*b* are substantially the same in the radial length.

In accordance with the provision of two second advance fluid pressure chambers 18*b* and 18*b* and two second retard fluid pressure chambers 19*b* and 19*b*, advance communication passage 32 of second hydraulic circuit 21 is branched into branch passages 32*a* and 32*b* connected to second advance fluid pressure chambers 18*b* and 18*b*, and retard communication passage 33 of second hydraulic circuit 21 is branched into branch passages 33*a* and 33*b* connected to second retard fluid pressure chambers 19*b* and 19*b*.

According to this embodiment, the construction that the total volumetric capacity of two second advance fluid pressure chambers 18*b* and 18*b* and two second retard fluid pressure chambers 19*b* and 19*b* of hydraulic actuation mechanism 5 is greater than that of first advance fluid pressure chamber 18*a* and first retard fluid pressure chamber 19*a* of camshaft-torque actuation mechanism 4, and the total pressure-receiving area of two second vanes 16*a* and 16*b* is greater than that of first vane 15, is effective for improving the dynamic responsiveness of both camshaft-torque actuation mechanism 4 and hydraulic actuation mechanism 5, as in the first embodiment.

The circumferential length of the newly-added second vane 16*b* is smaller than that of first vane 15 in order to balance rotation of first vane 15 and second vanes 16*a* and 16*b*.

Figure 5:
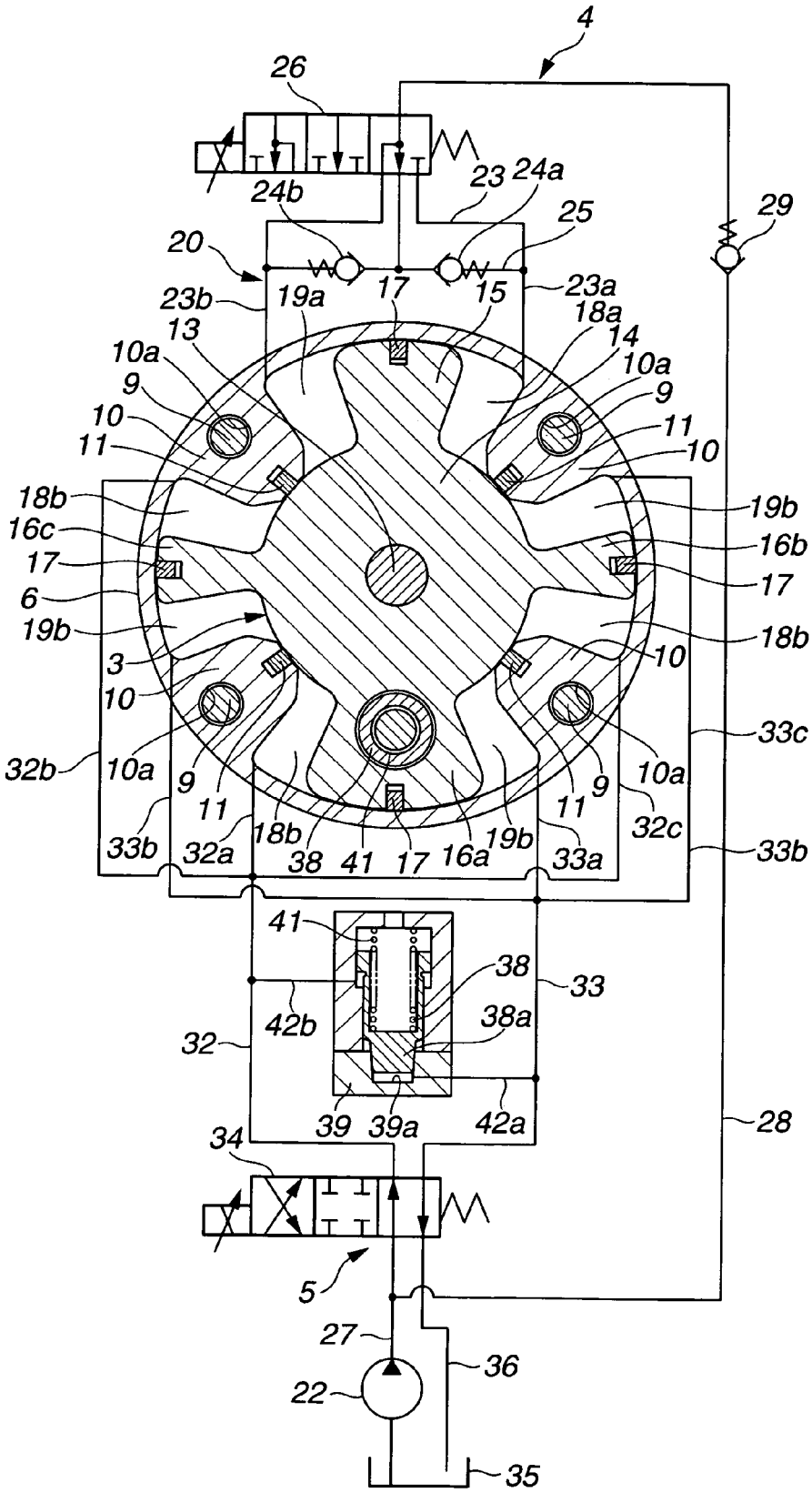
FIG. 5 is a sectional view showing a valve timing control apparatus of an internal combustion engine in accordance with a third embodiment of the present invention.

FIG. 5 shows a valve timing control apparatus of an internal combustion engine in accordance with a third embodiment of the present invention. The valve timing control apparatus of the third embodiment differs from that of the second embodiment in that: three second advance fluid pressure chambers 18*b*, 18*b* and 18*b* and three second retard fluid pressure chambers 19*b*, 19*b* and 19*b* are provided in hydraulic actuation mechanism 5; vane member 3 includes three second vanes 16*a*, 16*b* and 16*c*; the total volumetric capacity of three second advance fluid pressure chambers 18*b*, 18*b* and 18*b* and three second retard fluid pressure chambers 19*b*, 19*b* and 19*b* of hydraulic actuation mechanism 5 is further greater than that of first advance fluid pressure chamber 18*a* and first retard fluid pressure chamber 19*a* of camshaft-torque actuation mechanism 4; and the total pressure-receiving area of three second vanes 16*a*, 16*b* and 16*c* is further greater than that of first vane 15. In this embodiment, first vane 15, and second vanes 16*a*, 16*b* and 16*c* are substantially the same in the radial length.

In accordance with the provision of three second advance fluid pressure chambers 18*b*, 18*b* and 18*b* and three second retard fluid pressure chambers 19*b*, 19*b* and 19*b*, advance communication passage 32 of second hydraulic circuit 21 is branched into branch passages 32*a*, 32*b* and 32*c* connected to second advance fluid pressure chambers 18*b*, 18*b* and 18*b*, and retard communication passage 33 of second hydraulic circuit 21 is branched into branch passages 33*a*, 33*b* and 33*c* connected to second retard fluid pressure chambers 19*b*, 19*b* and 19*b*.

According to this embodiment, the construction that the total volumetric capacity of three second advance fluid pressure chambers 18*b*, 18*b* and 18*b* and three second retard fluid pressure chambers 19*b*, 19*b* and 19*b* of hydraulic actuation mechanism 5 is further greater than that of first advance fluid pressure chamber 18*a* and first retard fluid pressure chamber 19*a* of camshaft-torque actuation mechanism 4, and the total pressure-receiving area of three second vanes 16*a*, 16*b* and 16*c* is further greater than that of first vane 15, is effective for improving the dynamic responsiveness of both camshaft-torque actuation mechanism 4 and hydraulic actuation mechanism 5, as in the first embodiment.

Figure 6:
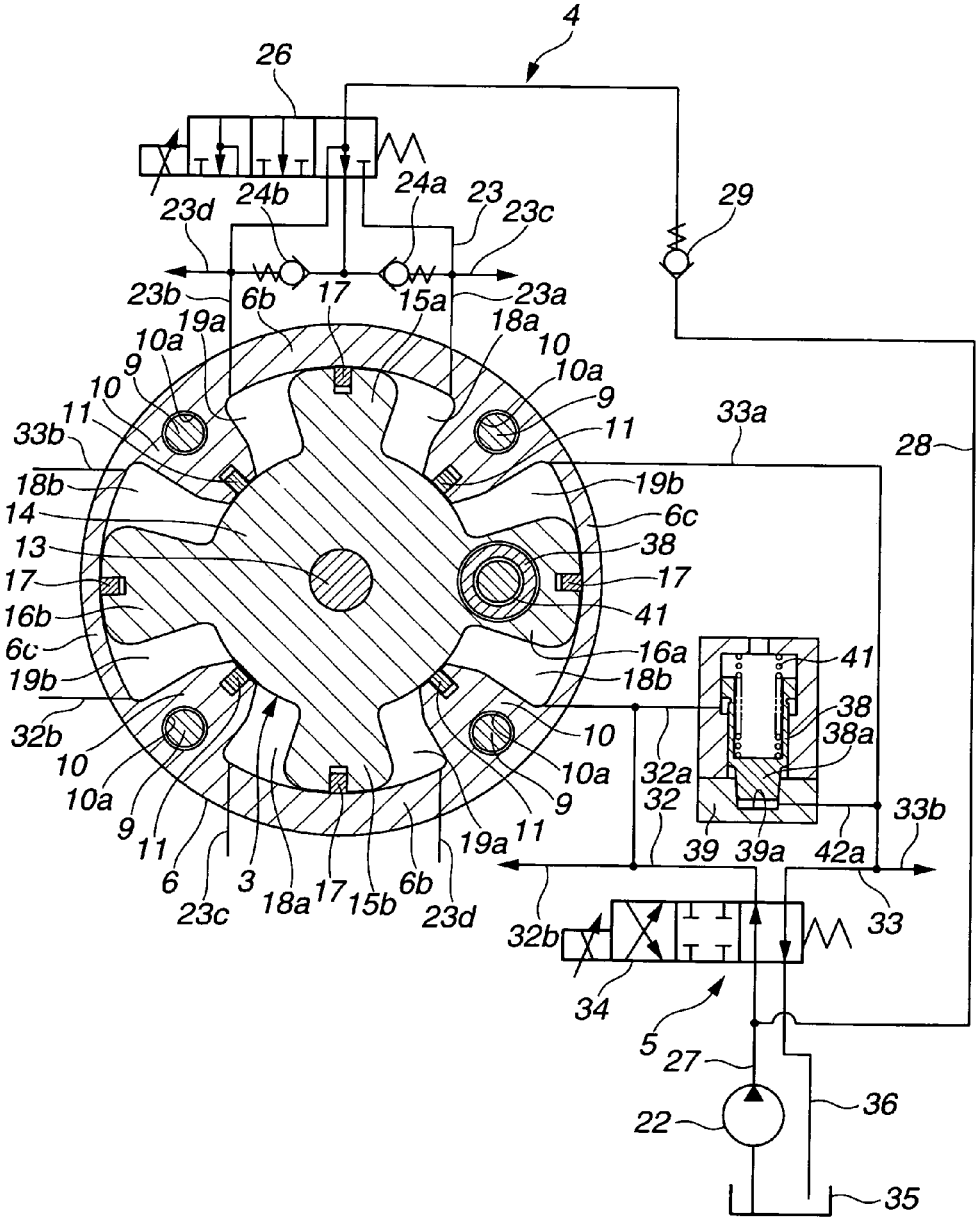
FIG. 6 is a sectional view showing a valve timing control apparatus of an internal combustion engine in accordance with a fourth embodiment of the present invention.

FIG. 6 shows a valve timing control apparatus of an internal combustion engine in accordance with a fourth embodiment of the present invention. The valve timing control apparatus of this example is constructed basically as in the third embodiment, and vane member 3 includes four vanes as in the third embodiment. In this example, two opposite vanes (top and bottom vanes in FIG. 6) are provided as first vanes 15*a* and 15*b* for camshaft-torque actuation mechanism 4, whereas two opposite vanes (left and right vanes in FIG. 6) are provided as second vanes 16*a* and 16*b* for hydraulic actuation mechanism 5. The thickness of arced portions 6*b* and 6*b* of housing 6 in contact with first vanes 15*a* and 15*b* is greater than that of arced portions 6*c* and 6*c* of housing 6 in contact with second vanes 16*a* and 16*b* as in the first embodiment. Accordingly, the radial length of first vanes 15*a* and 15*b* is shorter than that of second vanes 16*a* and 16*b*.

Two pairs of first advance fluid pressure chamber 18*a* and first retard fluid pressure chamber 19*a* defined and divided by one of first vanes 15*a* and 15*b* are provided in mechanism 4, serving as camshaft-torque actuation chambers.

Two pairs of second advance fluid pressure chamber 18*b* and second retard fluid pressure chamber 19*b* defined and divided by one of second vanes 16*a* and 16*b* are provided in hydraulic actuation mechanism 5, serving as hydraulic actuation chambers.

Each first advance fluid pressure chamber 18*a* is connected to one of branch passages 23*a* and 23*c* of communication passage 23, whereas each first retard fluid pressure chamber 19*a* is connected to one of branch passages 23*b* and 23*d* of communication passage 23.

Each second advance fluid pressure chamber 18*b* is connected to one of branch passages 32*a* and 32*b* of advance communication passage 32, whereas each second retard fluid pressure chamber 19*b* is connected to one of branch passages 33*a* and 33*b* of retard communication passage 33.

According to this embodiment, the construction that the total pressure-receiving area of two second vanes 16*a* and 16*b* is greater than that of first vanes 15*a* and 15*b*, is effective as in the first embodiment, whereas the construction that first vanes 15*a* and 15*b* are evenly arranged and second vanes 16*a* and 16*b* are also evenly arranged, is effective for improving the total balance of normal and reverse rotation of vane member 3 induced by camshaft-torque actuation mechanism 4 and hydraulic actuation mechanism 5.

Figure 7:
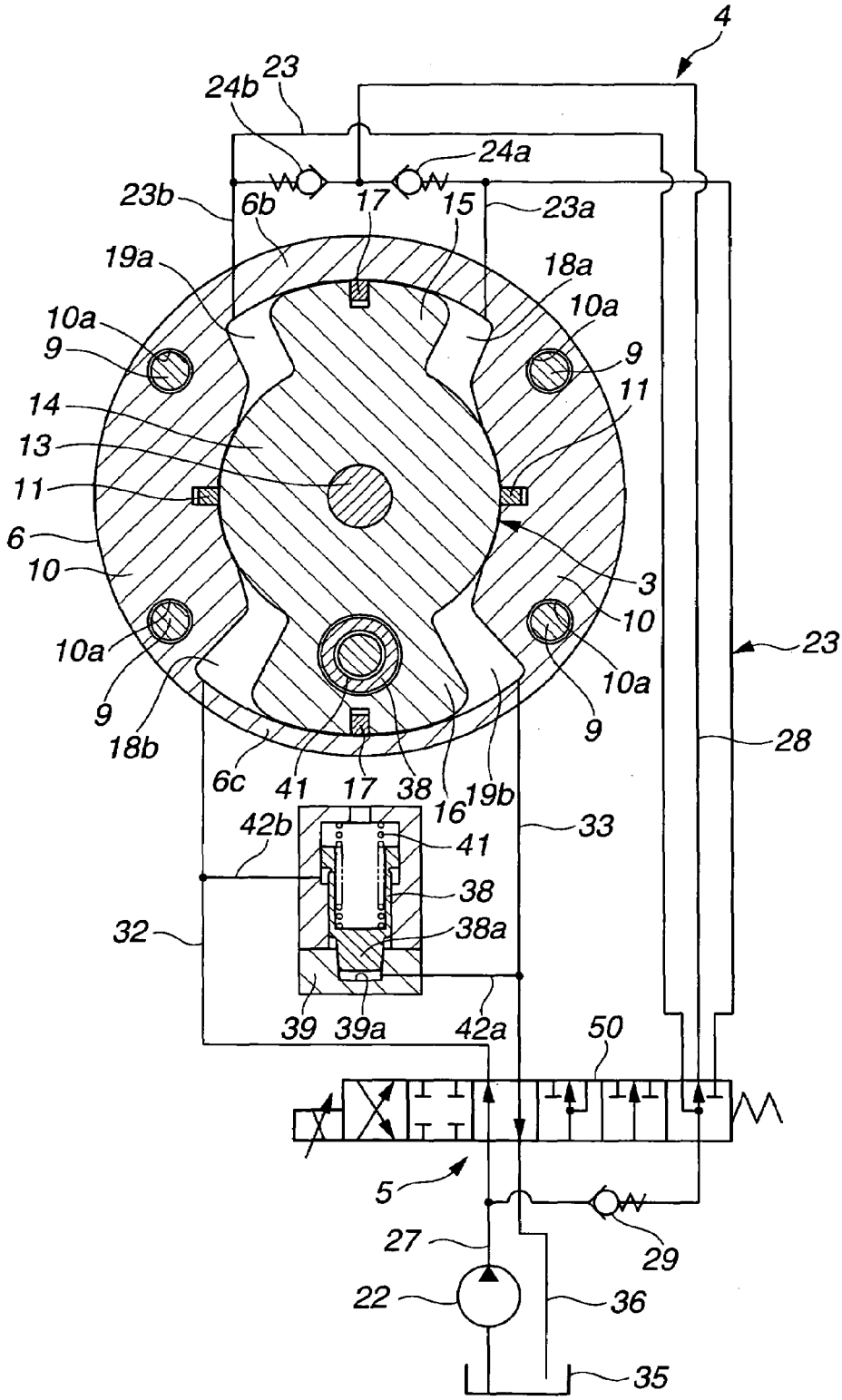
FIG. 7 is a sectional view showing a valve timing control apparatus of an internal combustion engine in accordance with a fifth embodiment of the present invention.

FIG. 7 shows a valve timing control apparatus of an internal combustion engine in accordance with a fifth embodiment of the present invention. The valve timing control apparatus of this example includes the same basic structure, such as the same dimensions of first vane 15 and second vane 16, as in the first embodiment. The valve timing control apparatus of this example differs from that of the first embodiment in that a third directional control valve 50 is provided instead of first directional control valve 26 and second directional control valve 34.

When the engine is, for example, in an idling state, third directional control valve 50 operates in response to a control current outputted from the controller in such a manner that an inside spool valve element switches communication passage 23 so that the working fluid flows from first retard fluid pressure chamber 19*a* into first advance fluid pressure chamber 18*a*, and that at the same time, second retard fluid pressure chamber 19*b* is connected to drain passage 36 via retard communication passage 33 and second advance fluid pressure chamber 18*b* is connected to main gallery 27 via advance communication passage 32.

As a result of the above, camshaft-torque actuation mechanism 4 drives the vane member 3 to rotate counterclockwise in FIG. 7 to alter the relative rotational phase of camshaft 2 with respect to timing sprocket member 1 to the most advanced position.

When the engine enters the middle and high speed region, third directional control valve 50 operates in response to the control current from the controller in such a manner that communication passage 23 is switched so that the working fluid flows from first advance fluid pressure chamber 18*a* to first retard fluid pressure chamber 19*a* and, at the same time, second advance fluid pressure chamber 18*b* is connected to drain passage 36.

In this example, third check valve 29 is arranged in replenishing passage 28 between third directional control valve 50 and oil pump 22.

As a result of the above, hydraulic actuation mechanism 5 drives the vane member 3 to rotate clockwise in FIG. 7 to alter the relative rotational phase of camshaft 2 with respect to timing sprocket member 1 to the most retarded position.

According to this embodiment, the construction that the radial length of second vane 16 is shorter than that of first vane 15, is effective for improving the dynamic responsiveness of camshaft-torque actuation mechanism 4 and hydraulic actuation mechanism 5 as in the first embodiment, and in addition, for reducing the manufacturing cost when compared with provision of a plurality of directional control valves.

The present invention is not limited to the illustrated embodiments. Various variations and modifications are possible. For example, the invention may be applied to an intake valve side of the internal combustion engine. In the case of the intake valve side, the valve timing control apparatus is configured so that vane member 3 rotates to the retard side when the engine is at idling. A spring may be provided for urging the vane member 3 to the advance side or retard side. This construction is effective for minimizing adverse influences of frictions acting on vane member 3 upon the dynamic responsiveness of vane member 3.

First directional control valve 26 may be modified to allow the working fluid to flow in a single direction from first retard fluid pressure chamber 19*a* into first advance fluid pressure chamber 18*a*. This construction is effective for reducing the manufacturing cost although the friction acting on vane member 3 is relatively large.

In addition to the construction that the working fluid is supplied selectively to second advance fluid pressure chamber 18*b* and to second retard fluid pressure chamber 19*b* in order to rotate the vane member 3 in normal and reverse directions, a device such as a spring may be provided to urge the vane member 3 in a single direction. This construction needs no supply of the working fluid to second advance fluid pressure chamber 18*b*, resulting in that the hydraulic circuit of the valve timing control apparatus has a simple structure as a whole.

This application is based on a prior Japanese Patent Application No. 2005-320247 filed on Nov. 4, 2005. The entire contents of this Japanese Patent Application No. 2005-320247 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A valve timing control apparatus for an internal combustion engine, comprising:

a driving rotator adapted to be rotated by a torque outputted from the internal combustion engine;

a driven rotator arranged to rotate with a relative rotational phase with respect to the driving rotator and adapted to transmit the torque from the driving rotator to a camshaft of the internal combustion engine via a torque transmission path;

a camshaft-torque actuation mechanism including at least a pair of camshaft-torque actuation chambers arranged in the torque transmission path, the camshaft-torque actuation mechanism being configured to alter the relative rotational phase by providing at least a state allowing a unidirectional flow of working fluid from one of the camshaft-torque actuation chambers to another of the camshaft-torque actuation chambers; and a hydraulic actuation mechanism including at least a pair of hydraulic actuation chambers arranged in the torque transmission path, the hydraulic actuation mechanism being configured to alter the relative rotational phase at least by supplying and draining working fluid to and from one of the hydraulic actuation chambers, a first rate of alteration with respect to alteration in the relative rotational phase, at which the hydraulic actuation chambers alter in volumetric capacity in accordance with the alteration in the relative rotational phase, being higher than a second rate of alteration with respect to the alteration in the relative rotational phase, at which the camshaft-torque actuation chambers alter in volumetric capacity in accordance with the alteration in the relative rotational phase.

2. The valve timing control apparatus as claimed in claim 1, wherein the driving rotator is adapted to be driven by a crankshaft of the internal combustion engine.

3. The valve timing control apparatus as claimed in claim 1, wherein the at least a pair of hydraulic actuation chambers is greater in number than the at least a pair of camshaft-torque actuation chambers.

4. The valve timing control apparatus as claimed in claim 1, wherein the camshaft-torque actuation mechanism is configured to alter the relative rotational phase by providing selectively at least a state allowing a unidirectional flow of working fluid from one of the camshaft-torque actuation chambers to another of the camshaft-torque actuation chambers and a state allowing a unidirectional flow of working fluid from the another of the camshaft-torque actuation chambers to the one of the camshaft-torque actuation chambers.

5. The valve timing control apparatus as claimed in claim 1, wherein the camshaft-torque actuation mechanism is configured to alter the relative rotational phase by providing selectively at least a state allowing a unidirectional flow of working fluid from one of the camshaft-torque actuation chambers to another of the camshaft-torque actuation chambers and a state allowing bidirectional flow of working fluid between the camshaft-torque actuation chambers.

6. The valve timing control apparatus as claimed in claim 1, wherein the hydraulic actuation mechanism is configured to alter the relative rotational phase by providing selectively at least a state in which working fluid is supplied to one of the hydraulic actuation chambers from outside and working fluid is drained from another of the hydraulic actuation chambers to outside and a state in which working fluid is supplied to the another of the hydraulic actuation chambers from outside and working fluid is drained from the one of the hydraulic actuation chambers to outside.

7. The valve timing control apparatus as claimed in claim 1, wherein the hydraulic actuation mechanism is configured to alter the relative rotational phase by providing selectively at least a state in which working fluid is supplied to one of the hydraulic actuation chambers from outside and working fluid is drained from another of the hydraulic actuation chambers to outside and a state in which both of the hydraulic actuation chambers are hydraulically connected to an outside low pressure section.

8. The valve timing control apparatus as claimed in claim 1, further comprising a fluid pump adapted to be driven by the internal combustion engine and arranged to supply working fluid to the hydraulic actuation mechanism.

9. The valve timing control apparatus as claimed in claim 1, wherein the camshaft-torque actuation mechanism and the hydraulic actuation mechanism are configured to operate in parallel with each other.

10. The valve timing control apparatus as claimed in claim 1, further comprising a solenoid-operated control valve arranged to control both of the camshaft-torque actuation mechanism and the hydraulic actuation mechanism.

11. The valve timing control apparatus as claimed in claim 1, further comprising a first solenoid-operated control valve arranged to control the camshaft-torque actuation mechanism and a second solenoid-operated control valve arranged to control the hydraulic actuation mechanism.

12. The valve timing control apparatus as claimed in claim 1, wherein the camshaft-torque actuation mechanism includes a check valve arranged to allow the unidirectional flow of working fluid.

13. The valve timing control apparatus as claimed in claim 1, wherein the camshaft-torque actuation chambers have a lower level of leak to outside than the hydraulic actuation chambers.

14. The valve timing control apparatus as claimed in claim 1, wherein the camshaft-torque actuation mechanism includes a replenishing hydraulic circuit arranged to replenish the cam-torque actuation chambers with an amount of working fluid leaking from the cam-torque actuation chambers.

15. The valve timing control apparatus as claimed in claim 14, wherein the camshaft-torque actuation mechanism includes a check valve arranged in the replenishing hydraulic circuit to allow a unidirectional flow of working fluid to the cam-torque actuation chambers.

16. The valve timing control apparatus as claimed in claim 1, wherein the camshaft-torque actuation mechanism and the hydraulic actuation mechanism are arranged to use, as a working fluid, a lubricating oil used to lubricate the internal combustion engine.

17. The valve timing control apparatus as claimed in claim 1, further comprising a lock mechanism arranged to lock, at start of the internal combustion engine, the relative rotational phase at a phase value allowing starting the internal combustion engine.

18. A valve timing control apparatus for an internal combustion engine, comprising:

a driving rotator adapted to be rotated by a torque outputted from the internal combustion engine;

a driven rotator arranged to rotate with a relative rotational phase with respect to the driving rotator and adapted to transmit the torque from the driving rotator to a camshaft of the internal combustion engine via a torque transmission path;

a camshaft-torque actuation mechanism including at least a pair of camshaft-torque actuation chambers arranged in the torque transmission path, the camshaft-torque actuation mechanism being configured to alter the relative rotational phase by providing at least a state allowing a unidirectional flow of working fluid from one of the camshaft-torque actuation chambers to another of the camshaft-torque actuation chambers; and a hydraulic actuation mechanism including at least a pair of hydraulic actuation chambers arranged in the torque transmission path, the hydraulic actuation mechanism being configured to alter the relative rotational phase at least by supplying and draining working fluid to and from one of the hydraulic actuation chambers, a first rate of flow with respect to alteration in the relative rotational phase, at which working fluid flows from the one of the camshaft-torque actuation chambers to the another of the camshaft-torque actuation chambers in accordance with the alteration in the relative rotational phase, being higher than a second rate of flow with respect to the alteration in the relative rotational phase, at which working fluid flows from and to the one of the hydraulic actuation chambers in accordance with the alteration in the relative rotational phase.

19. A valve timing control apparatus for an internal combustion engine, comprising:

a driving rotator adapted to be rotated by a torque outputted from the internal combustion engine;

a driven rotator arranged to rotate with a relative rotational phase with respect to the driving rotator and adapted to transmit the torque from the driving rotator to a camshaft of the internal combustion engine;

a vane member formed in one of the driving rotator and the driven rotator, the vane member including a first vane set and a second vane set;

a plurality of shoes formed in another of the driving rotator and the driven rotator;

a camshaft-torque actuation mechanism including at least a pair of camshaft-torque actuation chambers defined by the first vane set and the shoes, the camshaft-torque actuation mechanism being configured to alter the relative rotational phase by providing at least a state allowing a unidirectional flow of working fluid from one of the camshaft-torque actuation chambers to another of the camshaft-torque actuation chambers; and a hydraulic actuation mechanism including at least a pair of hydraulic actuation chambers defined by the second vane set and the shoes, the hydraulic actuation mechanism being configured to alter the relative rotational phase at least by supplying and draining working fluid to and from one of the hydraulic actuation chambers, the second vane set having a larger total pressure-receiving area than the first vane set.

20. The valve timing control apparatus as claimed in claim 19, wherein the first vane set includes at least a first vane extending radially and outwardly from a base section of the one of the driving rotator and the driven rotator, wherein the second vane set includes at least a second vane extending radially and outwardly from a base section of the one of the driving rotator and the driven rotator, and wherein each of the shoes extends radially and inwardly from an inner circumferential surface of the another of the driving rotator and the driven rotator.

21. The valve timing control apparatus as claimed in claim 20, wherein the second vane has substantially the same circumferential length as the first vane and has a longer radial length than the first vane.

22. The valve timing control apparatus as claimed in claim 20, wherein the at least a second vane is greater in number than the at least a first vane.

23. The valve timing control apparatus as claimed in claim 20, wherein a first clearance between the first vane and a sliding surface of the another of the driving rotator and the driven rotator on which the first vane is arranged to slide is smaller than a second clearance between the second vane and a sliding surface of the another of the driving rotator and the driven rotator on which the second vane is arranged to slide.

* * * * *